US006421974B1

(12) United States Patent
Whitehouse et al.

(10) Patent No.: US 6,421,974 B1
(45) Date of Patent: Jul. 23, 2002

(54) CLADDING

(75) Inventors: Nicholas A. Whitehouse, Leighton Buzzard; David N. Varley, Long Eaton; Philip J. Smith, Ilkeston, all of (GB)

(73) Assignee: Terrapin International Limited, Keynes (GB)

( * ) Notice: Subject to any disclaimer, the term of this patent is extended or adjusted under 35 U.S.C. 154(b) by 0 days.

(21) Appl. No.: 09/555,214

(22) PCT Filed: Nov. 26, 1998

(86) PCT No.: PCT/GB98/03545

§ 371 (c)(1),
(2), (4) Date: May 26, 2000

(87) PCT Pub. No.: WO99/27212

PCT Pub. Date: Jun. 3, 1999

(30) Foreign Application Priority Data

Nov. 26, 1997 (GB) ..... 9724989

(51) Int. Cl.[7] ..... E04B 1/38

(52) U.S. Cl. ..... 52/510; 52/747.11; 52/384; 52/387

(58) Field of Search ..... 52/506.01, 506.05, 52/506.08, 506.1, 509–512, 384, 385, 387, 747.11, 747.12

(56) References Cited

U.S. PATENT DOCUMENTS

| | | | | |
|---|---|---|---|---|
| 2,073,130 A | * | 3/1937 | Wallace | 52/510 |
| 4,238,915 A | * | 12/1980 | Yoshida et al. | 52/510 |
| 4,916,875 A | * | 4/1990 | Kashiwagi | 52/302 |

FOREIGN PATENT DOCUMENTS

| | | | |
|---|---|---|---|
| EP | 0281509 | | 9/1988 |
| EP | 0470814 | | 2/1992 |
| GB | 2155970 | | 10/1985 |
| GB | 2159848 | | 12/1985 |
| GB | 2280690 | | 8/1995 |
| GB | 2299124 A | * | 9/1996 |
| GB | 2319543 | | 5/1998 |

* cited by examiner

*Primary Examiner*—Carl D. Friedman
*Assistant Examiner*—Naoko Slack
(74) *Attorney, Agent, or Firm*—Dowell & Dowell, P.C.

(57) ABSTRACT

A clad structure and method of cladding a structure with horizontally extending, elongate supports, each support having an upper flange with a downwardly extending lip defining an open-bottomed groove and a lower flange with a tile retention protrusion along its upper surface. The tiles have upper flanges extending upwardly from their upper edge and ribs extending horizontally along a lower region of their rear surfaces. The upper flanges are positioned into the support groove during assembly and the ribs are retained behind the retention protrusions following assembly.

7 Claims, 5 Drawing Sheets

CLADDING

BACKGROUND OF THE INVENTION

FIELD OF THE INVENTION

The present invention is directed to methods and apparatus for cladding structures to create a simulated tile or brick wall appearance.

Although framed buildings may be erected relatively cheaply and quickly in comparison with buildings constructed using conventional brick-laying techniques, the appearance of a conventional brick building is often preferred. The present proposal concerns a method of simulating a brick wall, and may be employed to clad a wall of a framed building or other structure.

DESCRIPTION OF THE PREFERRED EMBODIMENT

Figure 1:
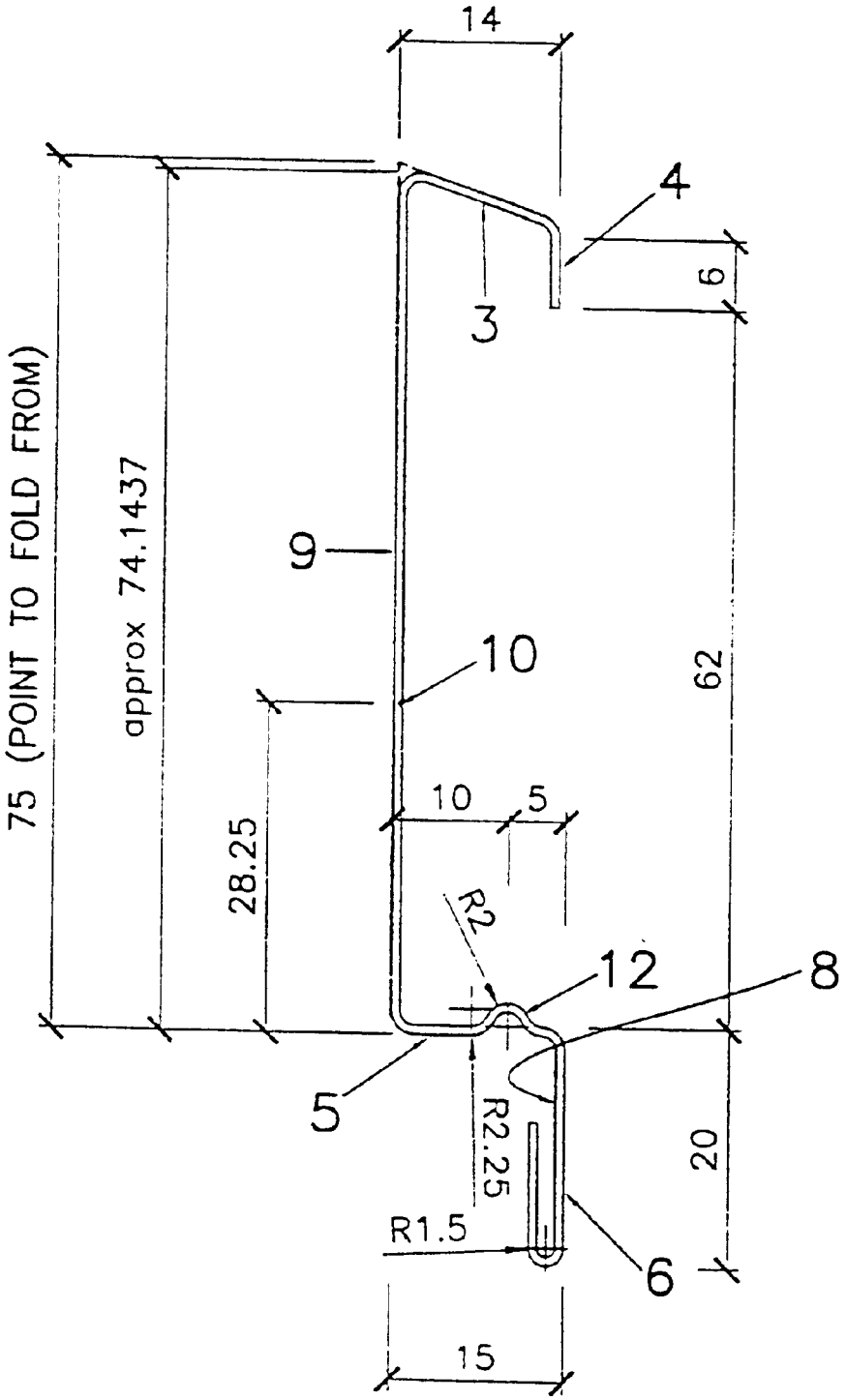
FIG. 1 is a dimensioned vertical section through a tile support.

Referring to FIG. 1, a tile support is formed by folding a metallic strip into the cross-sectional shape shown. The strip may be formed from aluminium, aluminium alloy or other suitable materials. Considering the strip to extend horizontally with its horizontal centre line perpendicular to the plane of the paper, it will be seen to have a downwardly inclined flange 3 along its upper edge and a horizontal flange 5 along its lower edge.

Both flanges extend from what will be regarded herein as the front side of the support. The flange 3 terminates in a depending lip 4. The flange 5 terminates in a depending hook-shaped profile 6, which defines a channel 8 opening upwardly on its rear side. The web 9 of the strip has a horizontal score line 10 to facilitate drilling screw holes. Pips 12 are pressed upwards from the flange 5 at intervals. At least one of the flanges is sprung relative to the web.

The support may be cut to the same length as the wall to be clad, or a plurality of supports may be arranged end to end.

Figure 4:
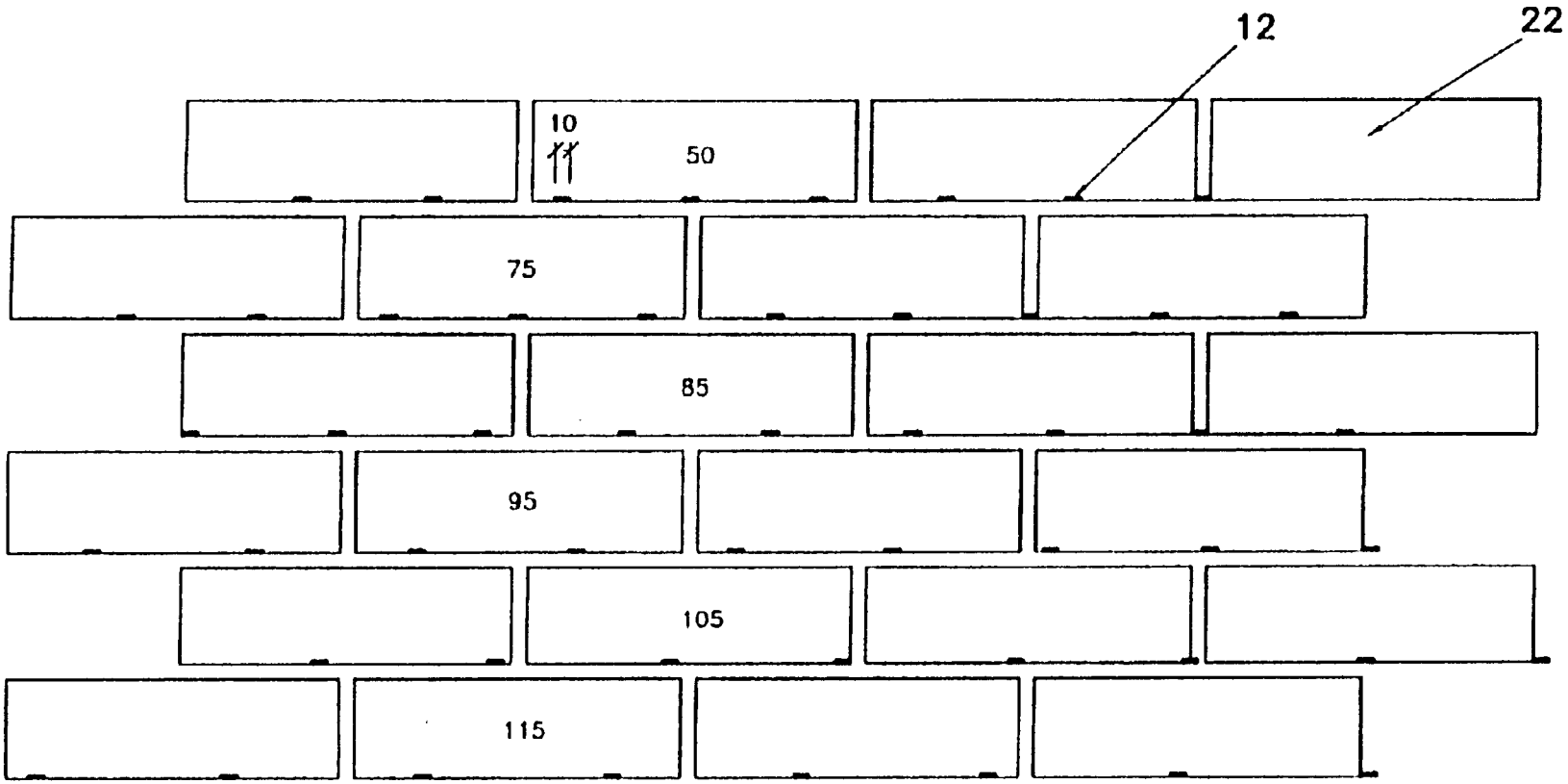
FIG. 4 is a front elevation showing an array of tiles simulating a brick wall to illustrate pip spacing.

A tile to be mounted on the support is of generally rectangular shape in elevation (as shown in FIG. 4). The tile may be manufactured from clay, cement or synthetic materials. Considering the tile to extend horizontally with its horizontal centre line perpendicular to the plane of the paper, it has the vertical cross-sectional shape shown in FIG. 2. The main body portion 20 of the tile has a front surface 22 which is dimensioned to correspond to the major dimensions of the brick to be simulated. A first flange 24 extends upwardly from the body 20 throughout the length of the tile with the front face of the flange spaced rearwardly from the tile face 22. The flange 24 terminates in an upper edge 25 and its rear surface is bevelled where it meets edge 25. A rib 26 extends horizontally the length of the rear side of the tile at a position spaced from the lower edge of the tile equal to approximately one-third of the height of front face 22. The rib is shaped to define an undercut groove 28 in its lower surface. A groove 30 is defined between the flange 24 and rib 26. The tile extends downwards from the rib 26 to terminate in a lower, horizontal edge 32. The rear faces of the flange 24 and rib 26 lie in the same plane. It is not essential for the flange 24 and rib 26 to extend the length of the tile and each may be of discontinuous form, so as to constitute spaced ribs.

Figure 2:
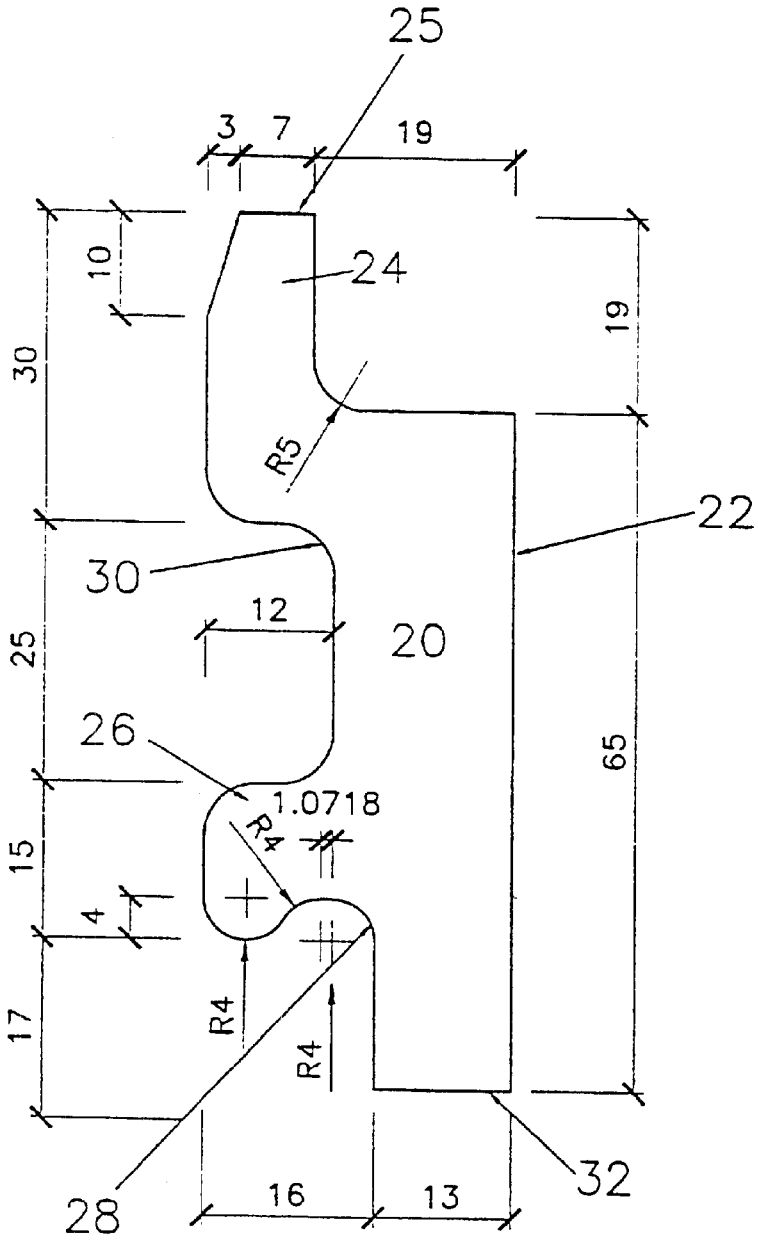
FIG. 2 is a dimensioned vertical section through a single tile used to simulate a brick.

The preferred vertical cross-sectional dimensions of the tile and tile support are indicated in FIGS. 1 and 2 in millimetres purely by way of example. The horizontally extending edges of the tile are rounded and bevelled as shown to facilitate hanging.

Figure 3:
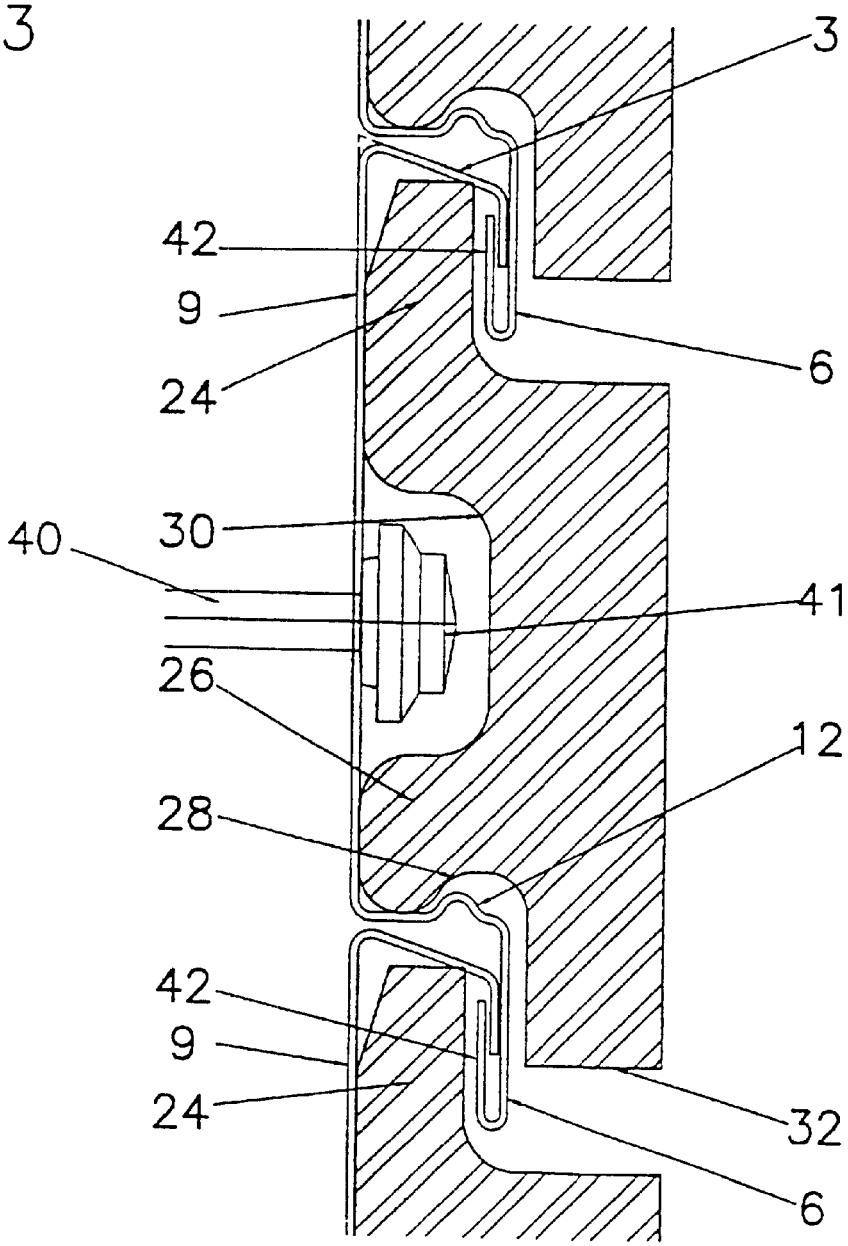
FIG. 3 is a vertical section through tiles supported on tile supports.

Referring now to FIG. 3, a wall or other support surface is clad by first fixing to it rows of the tile supports shown in FIG. 1, one above the other, with the lip 4 of an upper support interfitting with the groove 8 of the support immediately below it. Conveniently the supports are fitted into place one after another by screws or bolts 40 screwed into the wall and passed through holes drilled in the webs of the supports along the line 10. After one support is fixed into place, the lip 4 is interfitted with the groove 8 of the next adjacent support which is then similarly screwed or bolted into place, assuming that the supports are fitted starting from the bottom of the wall. It is of course possible to fix the supports in reverse order, starting at the top of the wall and ending at the bottom.

The tiles may be fitted by offering up the flanges 24 of the lowest row of tiles to the groove 42 defined by the profile 6 and web 9. The flange 24 of each tile may be used to press the flange 3 upwards to allow the bottom of rib 26 to be moved past the pips 12 and bring the tiles into the position shown in FIG. 3. In this position the head 41 of screw or bolt 40 is received within the groove 30, and the pips 12 are received within the groove 28 and restrain the tile against slipping out. Flange 3 provides a spring force which presses the tile downwards. The adjacent rows of tiles are vertically spaced from one another by the conventional distance used in brick laying, as are the tiles in each row. The tiles do not contact one another, but the body portion of each tile projects downwards so as to overlap the flange 24 of the tile or tiles immediately below it and the overlying interfitting portions of the supports. The gaps between the tiles may be pointed in the ordinary way.

Each of the pips 12 may have a length of 10 mm, and the inter-pip spacing may be selected to give the most suitable result. FIG. 4 illustrates the relationship between tiles and pips at various different possible inter-pip spacings ranging from 50 mm to 115 mm, the optimum spacing being 95 mm. A greater spacing risks insufficient support for the row of tiles, whereas lesser spacing involves unnecessary working of the strip. Instead of using pips to retain the tiles it is possible to provide the flange 5 with a continuous bead, but this involves the risk of water accumulating behind the bead.

Figure 3A:
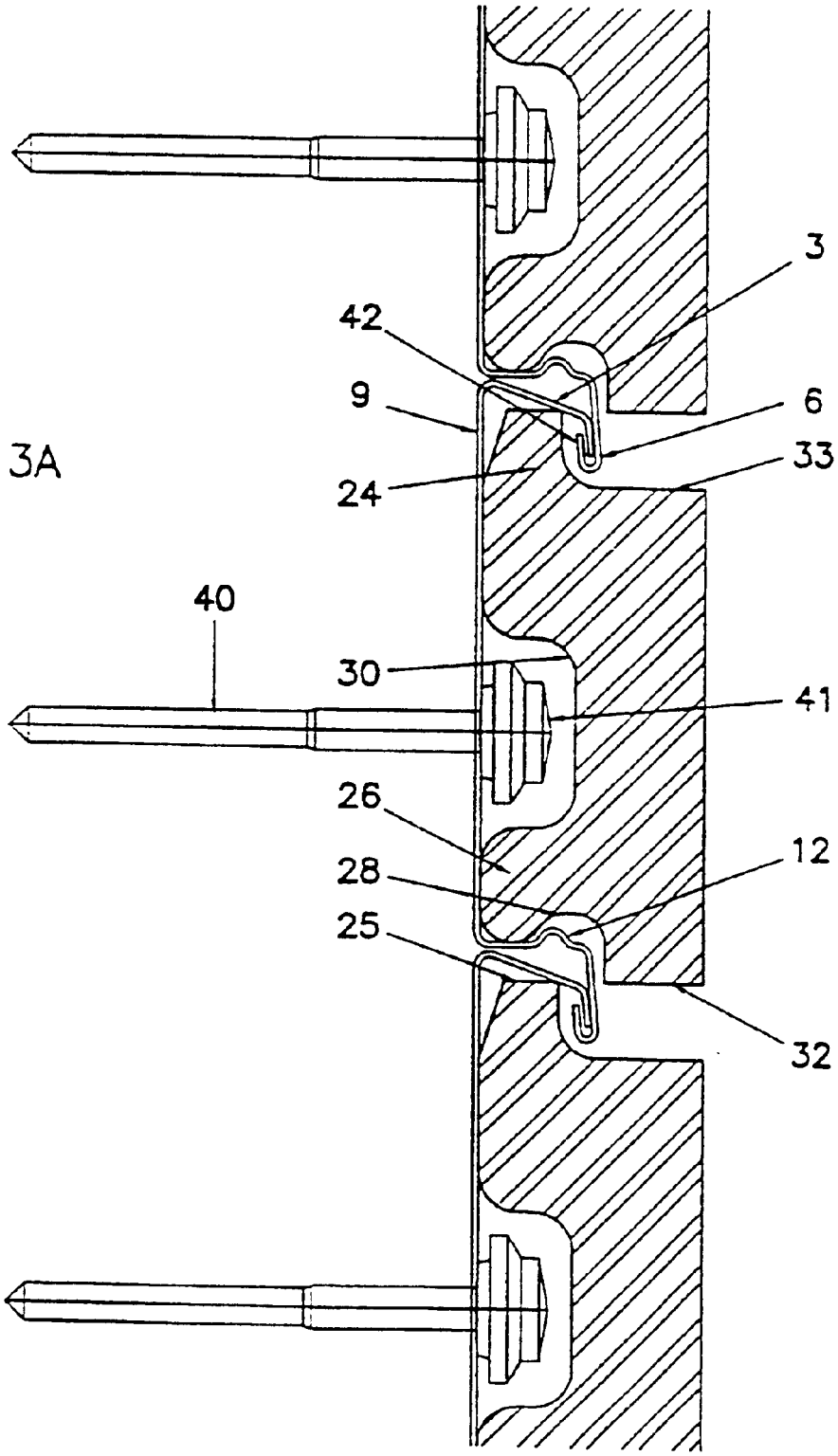
FIG. 3A is a view similar to FIG. 3 but showing a modified construction of tile and tile support.

FIG. 3A is a view similar to FIG. 3 but showing modified tiles and strips. In particular, the flange 24 is shorter and the lower edge 32 of the tile is closer to the rib 26 than in the case of the tile shown in FIGS. 2 and 3. In consequence, the lower edge 32 of each tile is at substantially the same level or slightly above the upper edges 25 of the flanges 24 of the tiles in the next adjacent tower row. This arrangement facilitates removal and replacement of damaged tiles. To take account of the fact that there is a reduced gap between the groove 28 of each tile and the upper edges 33 of the tiles in the next adjacent lower row, the hook-shaped profiles 6 of the strips are also made shorter.

Compared with existing systems, the present invention provides a superior method of simulating conventional brick walls. In particular, the invention provides the following advantages:

(a) a mechanical fixing for the tiles so as to eliminate weather-reliant processes such as bonding, b) weather-proofing of the support surface prior to fixing of the tiles, c) removability of individual tiles if damaged, d) good impact-resistance as a result of the thickness of the tiles and their intimate contact with the support structure, e) installation by unskilled labour because the tile supports are self-aligning and accurate measurements do not need to be taken, and f) location of each tile within the tile support is independent of other tiles so that the system can accommodate the tolerances inherent in the manufacture of clay components.

Substantially the entire area of that part of the support surface to be clad with tiles is covered with the interlocking tile supports. This procedure increases the speed at which a building may be clad. Moreover, because the supports are made from metal and interfit so as to leave no openings through which water may penetrate, they cooperate to provide a waterproof shield within the tile cladding. The supports may be fixed by means other than screwing, for example by nailing, clipping or fixing to projecting studs. Within the scope of the invention it is not essential for all of the tiles in a row to simulate bricks.

In an alternative construction, the upper edge of each tile support is unprofiled, and the lower edge is bent so as to form a flange and define the pips 12 and the sprung portion 3, thereby to support and retain the lower edges of one row of tiles and retain the upper edges of another row of tiles. The edge of the sprung portion bears against the upper edge of the adjacent strip to prevent water penetration. The upper edges of the uppermost row of tiles may be retained by a separate retaining strip.

What is claimed is:

1. A clad structure including;

a) a plurality of elongate supports arranged one above another, each of said elongate supports having;

(i) a web which is secured to the structure, (ii) vertically spaced-apart flanges arranged along horizontal edges of the elongate support so as to project away from the structure, said flanges of each elongate support including;

an upper flange (3) having a downwardly extending lip (4), and a lower flange (5) having a tile retention protrusion (12) on an upper surface, an edge of the lower flange being turned upwards on a side nearer the web so as to have a hook-shaped profile (6) defining an open-topped channel (8);

b) the lip (4) of the upper flange of one elongate support being received in the open-topped channel (8) provided by the lower flange of the next adjacent upper elongated support, so that the upper and lower flanges are interconnected and define an open-bottomed groove (42);

c) and a plurality of tiles, each tile having;

(i) a flange (24) projecting upwardly from an upper edge of the tile, which flange is spaced from a front surface of the tile, and (ii) a rib (26) on a rear surface of the tile, the rib being disposed in a lower region of the tile, said upwardly projecting flange of the tile being received in said open-bottomed groove (42) and the rib being retained behind the protrusion (12); and d) the plurality of tiles being secured to the plurality of elongate supports in rows with rows with tiles in rows above a lowest row being spaced from tiles in a row immediately below.

2. A clad structure as claimed in claim 1, wherein the upper flange of each of the plurality of elongate supports has a downwardly inclined portion which applies a spring force to a tile to press it downwards.

3. A clad structure as claimed in claim 2, wherein horizontal and vertical dimensions of front edges of each of the plurality of tiles correspond to those of conventional bricks.

4. A clad structure as claimed in claim 3, wherein gaps between the plurality of tiles are pointed.

5. A clad structure as claimed in claim 4, wherein a groove (30) is defined between the flange and rib provided on each tile, said groove receiving a head of a fixing means (40) securing the web to the structure.

6. A clad structure comprising;

a) a plurality of elongate supports arranged one above another, each of said elongate supports having;

(i) a web which is secured to the structure, (ii) vertically spaced-apart flanges arranged along horizontal edges of the support so as to project away from the structure, the flanges of each elongate support including, an upper flange defining with the web an open-bottomed groove, a lower flange having a tile retention protrusion on its upper surface, (iii) one of said upper and lower flanges being shaped to define a channel, b) the plurality of elongate supports being secured to the structure with a lip on a flange of one elongate support being received in the channel defined by one of said upper and lower flanges of an adjacent elongate support so as to interconnect the flanges and prevent water penetration, c) a plurality of tiles, each tile having;

(i) a flange projecting upwardly from an upper edge thereof, which flange is spaced from a front surface of the tile, and (ii) a rib on a rear surface of the tile disposed in a lower region of the tile and spaced from a lower edge thereof;

d) said upwardly projecting flange of each tile being received in the open bottomed groove and the rib being retained behind the protrusion of one of said plurality of elongate supports, e) the plurality of tiles being mounted to the plurality of elongate supports in rows such that tiles in rows above a lowest row are spaced from tiles in a row immediately below.

7. A method of cladding a structure, comprising:

a) providing a plurality of elongate supports each having a web and upper and lower flanges projecting from longitudinal edges of the web, b) providing a plurality of tiles, each tile having a flange (24) projecting from one of its edges and a rib (26) on a rear side of the tile in a region of an opposite edge of the tile opposite to said one edge, the rib being shaped to define an undercut groove (28) in a side of the rib nearer to said opposite edge of the tile, c) fixing the webs of the plurality of elongate supports to the structure so that the supports extend generally horizontally with the upper and lower flanges of the supports projecting away from the structure, the plurality of elongate supports being so arranged that a downwardly extending lip (4) at an extremity of the upper flange of one of the plurality of elongate supports is fitted into an open topped channel (8) defined by a rearwardly upturned edge portion of the lower flange of a next adjacent upper one of said plurality of elongate supports so as to interconnect the upper and lower flanges, d) fitting the plurality of tiles to the plurality of elongate supports, each of the plurality of tiles being fitted to an elongate support with its said one edge uppermost by inserting the flange (24) of the tile into a groove (42) defined between the web of the elongate support and interconnected flanges of the elongated support and an adjacent upper elongate support, and inserting the rib (26) behind a tile retention protrusion on the lower flange, such that said protrusion is received in said undercut groove.

* * * * *